United States Patent [19]

Longrod et al.

[11] 4,364,682

[45] Dec. 21, 1982

[54] ACOUSTIC MEMBER MOUNTING MEANS FOR USE IN TYPEWRITERS

[75] Inventors: Scott J. Longrod, Woodbury, Conn.; Robert M. DuRoss, Huntsville, Ala.

[73] Assignee: SCM Corporation, New York, N.Y.

[21] Appl. No.: 311,578

[22] Filed: Oct. 15, 1981

[51] Int. Cl.[3] ..... B41J 5/00

[52] U.S. Cl. ..... 400/477; 400/679; 400/686; 84/191; 84/403

[58] Field of Search ..... 400/86, 477, 479, 496, 400/689, 321, 690.2, 690.3, 679, 686; 181/200–202, 207–209; 248/632, 634, 635; 84/189, 191, 403

[56] References Cited

U.S. PATENT DOCUMENTS

| | | | |
|---|---|---|---|
| 818,874 | 4/1906 | Deagan | 84/403 |
| 1,364,860 | 1/1921 | Betts | 248/632 |
| 2,542,651 | 2/1951 | Franklin et al. | 310/347 |
| 2,702,703 | 2/1955 | Franceschetti | 267/63 R |
| 2,802,955 | 8/1957 | Kitterman | 310/348 |
| 3,443,469 | 5/1969 | Hiraoka | 84/403 X |
| 3,548,964 | 12/1970 | Krauss et al. | 248/605 |
| 4,058,044 | 11/1977 | Murakami | 84/403 X |
| 4,208,142 | 6/1980 | Chu | 400/320 |
| 4,258,356 | 3/1981 | Jalbert | 340/365 R |

FOREIGN PATENT DOCUMENTS

| | | | |
|---|---|---|---|
| 2850191 | 5/1979 | Fed. Rep. of Germany | 400/477 |
| 755273 | 8/1956 | United Kingdom | 248/632 |
| 1033974 | 6/1966 | United Kingdom | 248/634 |

*Primary Examiner*—Edgar S. Burr
*Assistant Examiner*—David A. Wiecking
*Attorney, Agent, or Firm*—Kenneth W. Greb; Ernest F. Weinberger

[57] ABSTRACT

An acoustic member mounting means for use in typewriters and similar machines wherein the mounting means includes first and second vibration insulating means which prevents undesired sound waves from being generated in the acoustic member.

18 Claims, 2 Drawing Figures

ACOUSTIC MEMBER MOUNTING MEANS FOR USE IN TYPEWRITERS

CROSS-REFERENCE TO RELATED APPLICATIONS

There are no presently pending related patent applications.

BACKGROUND OF THE INVENTION (1) Field of the Invention

This invention is used in a typewriter or similar machine in which an input signal generates sound waves in an acoustic member which are then converted into electrical pulses for controlling various typewriter functions. In order to make certain that sound waves are generated only by the input signals, means are provided for insulating the acoustic member from sound wave producing vibrations which would otherwise occur as a result of typewriter operation.

(2) Description of the Prior Art

Among the prior art patents which disclose a device for protecting an acoustic element from external vibration is the patent of R. E. Franklin et al, U.S. Pat. No. 2,542,651. This patent discloses a first insulating material 2 which holds a crystal plate-like vibrating element 1. The insulating material 2 is held in place by metal springs 7 which are carried by supporting yoke 6 preferably formed of insulating material. Another such prior art patent is the patent of D. M. Kitterman, U.S. Pat. No. 2,802,955, which discloses a first insulating element comprising plate-like members 84 and 86 secured to a base slab 88 for mounting crystal element 10. A second insulating element, base plate 16, is also provided. Among the prior art patents which disclose spring supports for objects such as machinery, is the patent of A. Franceschetti, U.S. Pat. No. 2,702,703. This patent discloses in FIG. 5, for example, a spring support formed of a number of metal plates 9 and rubber elements 8 arranged in series. The patent of H. Krauss et al, U.S. Pat. No. 3,548,964, discloses means for limiting movement of an elastically suspended engine unit comprising a first rubber cushion 28 on which a frame 30 is mounted, and a member 22 which connects first rubber cushion 28 to a second rubber cushion 36, 37.

None of the aforementioned patents, however, disclose a device similar to the invention disclosed herein for protecting an acoustic element from external vibrations.

SUMMARY OF THE INVENTION

The present invention is concerned in general with a typewriter or similar machine wherein input signals generate sound waves in an acoustic member which are then converted into electrical signals to control the typewriter functions. More particularly, the invention is concerned with a mounting means for such an acoustic member wherein the mounting means includes, among other things, a first insulating member in which the acoustic member means is affixed, a member which supports the first insulating member, and a second insulating member on which the support member is mounted.

BRIEF DESCRIPTION OF THE DRAWING

In the accompanying drawing,

FIG. 1 is an isometric view of the acoustic member mounting means and certain related typewriter elements.

DESCRIPTION OF THE PREFERRED EMBODIMENT

Figures 2, 7:
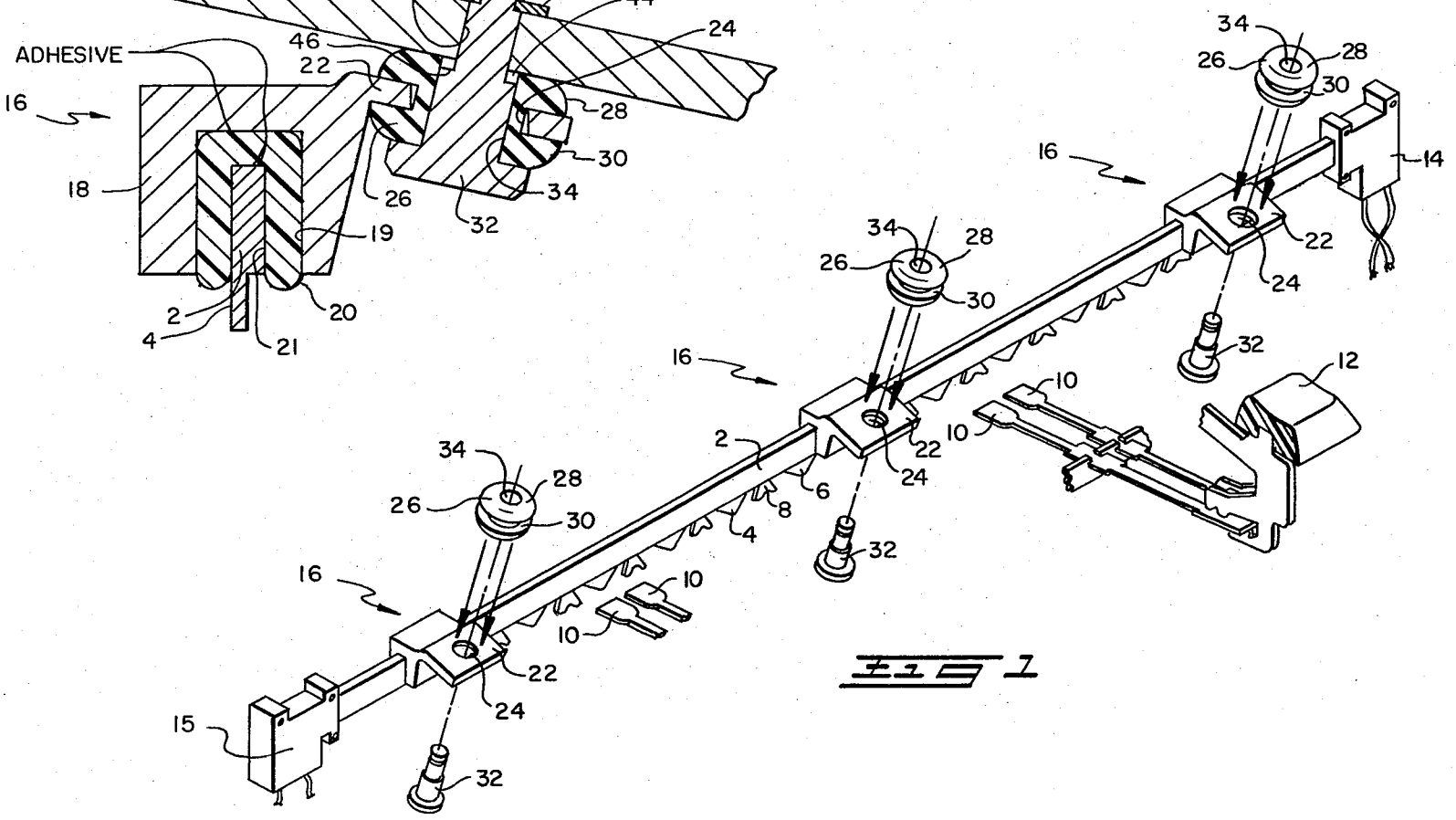
FIG. 2 is a side view of the acoustic member mounting means.

In FIG. 1 there is shown an acoustic member 2 in the shape of a rod having a number of teeth 4. In the illustrated embodiment the teeth 4 are of two different configurations, a first tooth configuration is shown at 6 and a second tooth configuration is shown at 8. Acoustic member 2 is located substantially perpendicular to and spaced from a series of strikers 10. Although only several strikers 10 are illustrated, there are separate strikers 10 for each tooth 4. Acoustic member 2 extends transverse to the typewriter keyboard (not shown) and the teeth 4 of acoustic member 2 are positioned with respect to strikers 10, so as to receive an impact blow from upward movement of strikers 10. A particular striker 10 will be moved upwardly into contact with teeth 4, as its corresponding keybutton 12 is depressed. When any striker 10 impacts its corresponding tooth 4, two sound waves are induced in acoustic member 2. One sound wave travels in the direction of transducer means 14, and the other sound wave travels in the direction of transducer means 15. Transducer means 14 and 15 are operatively connected to each end of acoustic member 2 and receive and convert the sound waves into corresponding electrical pulses. A time interval exists between the arrival time of the electrical pulses to a logic means (not shown), since the distance each divergent sound wave must travel toward the transducing means 14 and 15 is different. The logic means is provided with circuitry capable of sensing the arrival of each electrical pulse and measuring the difference in time of arrival of each pulse. Each striker 10 impacting its corresponding tooth 4 creates its own such time interval, and by measuring the time interval, the particular striker 10 which caused the generated pulses may be determined.

The means for mounting acoustic member 2 include a number of supports 16. It has been found desirable to employ three such supports; one support being located at the center of the acoustic member 2, and the two other supports located at the ends of the acoustic member 2. As seen in FIG. 2, support 16 includes a support member 18 having an opening 19 therein which may be U-shaped. A first insulating member 20 which may also be U-shaped is secured in the opening 19 of support member 18. First insulating member 20 may be a foam material such as the high density cellular polyurethane material sold under the trademark PORON by the Poron Division of the Rogers Corporation, East Woodstock, Connecticut. The durometer hardness of the first insulating member 20 is less than the durometer of a second insulating member 26, hereinafter described.

The durometer hardness is the hardness of a material as measured by a durometer which is an instrument consisting of a small drill or blunt indentor point under pressure.

The first insulating member 20 is secured in the opening of support member 18 by a gummy or rubber adhesive. The first insulating member 20 should have a nonporous skin to prevent absorption of the adhesive. Absorption of the adhesive into the first insulating member 20 is undesirable because such absorption hardens the insulating member 20, and reduces its capability to absorb vibration.

Acoustic member 2 is affixed in an opening 21, which may also be U-shaped, in first insulating member 20 by the same adhesive which secures first insulating member 20 in the opening 19 of support member 18. Acoustic member 2, first vibration insulating member 20, and support member 18 are located in a substantially vertical plane. It has been found desirable to completely surround acoustic member 2 with first insulating members 20, leaving only teeth 4 exposed. It has also been found desirable to provide insulating members 20 only at discrete positions along acoustic member 2, rather than to provide insulating material along the entire length of acoustic member 2. It is believed that providing insulating material along the entire length of acoustic member 2 would undesirably dampen the travel of the sound waves.

Support member 18 has a tab portion 22 including an opening 24 therein. Second insulating member 26 which may be in the shape of a rubber grommet having an upper portion 28 and a lower portion 30 is inserted into opening 24 of tab portion 22, so that upper portion 28 of second insulating member 26 is above tab portion 22 and lower portion 30 of second insulating member 26 is below tab portion 22. The second insulating member 26 may be of a gum or rubber material of the type manufactured by the Lavelle Rubber Company of Chicago, Ill.

A pin 32 extends through an opening in rubber grommet 26, and also extends through an opening 36 in typewriter frame member 38 which is shown in FIG. 2 to be a typewriter keylever extrusion.

A retainer 40 located in notches 42 of pin 32 retains pin 32 and thus the rubber grommet in typewriter frame member 38. It has been found desirable to provide a space 44 between a shoulder 46 of pin 32 and the bottom of the typewriter frame member 38 for the purpose of compressing the rubber grommet varying amounts during the assembly of the rubber grommet to the frame 38.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. In a typewriter in which input signals generate sound waves in an acoustic member, said typewriter having means for mounting the acoustic member comprising:

a first insulating means in which the acoustic member is affixed;

a member in which the first insulating means is supported;

a second insulating means on which the support member means is mounted; and, means for securing the second insulating means to a typewriter frame.

2. In a typewriter as set forth in claim 1, wherein the acoustic member, the first insulating means, and the support member are located in a substantially vertical plane.

3. In a typewriter as set forth in claim 2, wherein the second insulating means is located in a non-vertical plane.

4. In a typewriter as set forth in claim 1, wherein the first insulating means is urethane material.

5. In a typewriter as set forth in claim 1, wherein the second insulating means is gum rubber.

6. In a typewriter as set forth in claim 1, wherein the means for securing the second insulating means to the typewriter frame include a pin which extends through an opening in the second insulating means, and through an opening in the typewriter frame.

7. In a typewriter as set forth in claim 1, wherein the second insulating means is secured to a typewriter keylever extrusion.

8. In a typewriter as set forth in claim 1, wherein a substantial portion of the support member is U-shaped.

9. In a typewriter as set forth in claim 1, wherein a substantial portion of the first insulating means is U-shaped.

10. In a typewriter as set forth in claim 1, wherein the durometer hardness of the first insulating means is less than the durometer hardness of the second insulating means.

11. In a typewriter as set forth in claim 1, wherein the acoustic member is a rod having teeth extending therefrom.

12. In a typewriter as set forth in claim 1, wherein the first insulating means is adhesively secured in the support member.

13. In a typewriter as set forth in claim 12, wherein the first insulating means has a skin which prevents adhesive from being absorbed therein.

14. In a typewriter as set forth in claim 1, wherein the first insulating means include three discrete segments.

15. In a typewriter as set forth in claim 14, wherein one segment of the first insulating means is located in the center of the acoustic member, and the other two segments of the first insulating means are located near the ends of the acoustic member.

16. In a typewriter as set forth in claim 1, wherein the acoustic member is adhesively secured in the first insulating means.

17. In a typewriter as set forth in claim 15, wherein the acoustic member is a rod having teeth extending therefrom, and wherein the segments of the first insulating material surround the rod, except for the teeth extending therefrom.

18. In a typewriter as set forth in claim 1, wherein the support member has a tab portion having an opening therein through which the second insulating means extends.

* * * * *